US005604084A

United States Patent [19]

Grzeskowiak et al.

[11] Patent Number: 5,604,084

[45] Date of Patent: Feb. 18, 1997

[54] CHEMICAL SENSITISATION OF SILVER HALIDE EMULSIONS

[75] Inventors: Nicholas E. Grzeskowiak; Rachel J. Hobson, both of Harlow; Andrew W. Mott, Bishop's Stortford, all of Great Britain

[73] Assignee: Imation Corp., Woodbury, Minn.

[21] Appl. No.: 545,552

[22] Filed: Oct. 19, 1995

[30] Foreign Application Priority Data

Nov. 18, 1994 [GB] United Kingdom ..... 9423266

[51] Int. Cl.[6] ..... G03C 1/04; G03C 1/09

[52] U.S. Cl. ..... 430/567; 430/569; 430/603

[58] Field of Search ..... 430/603, 567, 430/569

[56] References Cited

U.S. PATENT DOCUMENTS

| | | | |
|---|---|---|---|
| 3,046,133 | 7/1962 | Minsk | 430/603 |
| 3,046,134 | 7/1962 | Dann et al. | 430/603 |
| 3,615,500 | 10/1971 | Huckstadt | 430/377 |
| 3,689,273 | 9/1972 | Willems et al. | 430/603 |
| 3,779,769 | 12/1973 | Abel | 430/609 |
| 3,813,247 | 5/1974 | Minsk et al. | 430/627 |
| 3,917,485 | 11/1975 | Morgan | 430/606 |
| 5,041,367 | 8/1991 | Sniadoch | 430/603 |
| 5,061,614 | 10/1991 | Takada et al. | 430/569 |
| 5,079,138 | 1/1992 | Takada | 430/567 |
| 5,254,456 | 10/1993 | Yamashita et al. | 430/611 |
| 5,368,999 | 11/1994 | Makino | 430/603 |

FOREIGN PATENT DOCUMENTS

| | | |
|---|---|---|
| 1115906 | 5/1989 | Japan . |
| 927178 | 5/1963 | United Kingdom . |
| 942932 | 11/1963 | United Kingdom . |

*Primary Examiner*—Mark F. Huff

*Attorney, Agent, or Firm*—Mark A. Litman; Arlene K. Musser

[57] ABSTRACT

A method of chemical sensitisation which comprises providing a silver halide emulsion containing negative-acting silver halide grains, and adding to said silver halide emulsion a sulphur releasing organic polymer having multiple sulphur releasing groups per polymer molecule. The polymer preferably has at least 10 sulphur releasing groups per molecule which may be selected from thiocarbonate, dithiocarbonate, trithiocarbonate, dithioester, thioamide, thiocarbamate, dithiocarbamate, thiouram, thiourea, dithiooxamide, thioketone and trisulphide.

20 Claims, No Drawings

CHEMICAL SENSITISATION OF SILVER HALIDE EMULSIONS

FIELD OF THE INVENTION

The invention relates to the chemical sensitisation of silver halide emulsions and in particular to sulphur sensitisation.

BACKGROUND TO THE INVENTION

Silver halide is reduced to silver metal in developing solutions used in the processing of photographic materials, the reaction being catalysed by clusters of silver atoms which form on the silver halide grains in the emulsion during exposure to light. In general, it is necessary to carry out a process of chemical sensitisation prior to coating the emulsion to form preferential sites on the grains for the latent imaging process to occur. Chemical sensitisation is particularly important for emulsions of high sensitivity having larger silver halide grains, e.g., those of mean volume exceeding 0.1 cubic microns which have many competing sites at defects within the grains where photoelectrons derived on exposure may otherwise be dissipated without contributing to formation of silver specks useful for catalysing development.

Chemical sensitisation usually takes place after both completion of the growth of the silver halide grains in gelatine and removal of ionic by-products. Generally, the emulsion is sensitised by the addition of small molecule sulphide-releasing compounds, for example, sodium thiosulphate, usually in the presence of gold compounds.

During a period of maturation at an elevated temperature, the emulsion progressively undergoes a larger increase in sensitivity to light. This sensitivity increase is due to formation on the grains of small deposits of silver sulphide, or mixed silver/gold sulphides, which act as the required preferential sites for trapping of photoelectrons and their reaction with interstitial silver ions to assemble the catalytic $Ag^{\circ}$ clusters. The photoelectrons may be generated by exposure to blue or UV light, which the silver halide is naturally able to capture, or to light of longer wavelength captured using sensitising dyes additionally adsorbed to the grain surface.

A basic problem in practising chemical sensitisation is the formation of excess silver sulphide on the grain surface during the course of the digestion process used to create centres conferring maximum sensitivity on the majority of grains. The factors controlling deposition of silver sulphide are; quantity and type of sulphide releasing compound added; bulk $Ag^+$ and $H^+$ concentrations in the emulsions; reaction temperature; duration of heating; and adsorption of additional compounds to the grain surface.

Depending on the choice of these variables, sensitisation of the emulsion may be accompanied by the formation of fogged (spontaneously developable) grains; the formation of competing sensitivity speck sites, resulting in fragmented latent image, so that a higher light exposure is needed to enable development; and the formation of diffuse $Ag_2S$ that does not influence latent image formation as such, but confers unwanted red light sensitivity to the emulsion, due to the red adsorption band of $Ag_2S$.

By avoiding the use of high $Ag^+$ ion concentration or high pH, limiting the amount of S-sensitiser, and stopping sensitisation by thermal quenching after an optimum duration, sulphide deposition can normally be controlled so as to proceed to a point of giving maximum sensitivity consistent with a just perceptible rise in optical density in non light struck areas (DMIN) due to spontaneous developability. By extending or shortening the heating period it is possible to obtain an acceptable level of sensitivity at low DMIN from a range of different amounts of a given sulphur sensitiser such as thiosulphate, even under conditions where the sensitiser reacts rapidly with the AgX surface so that a largely complete transfer of sulphide takes place. The excess $Ag_2S$ generated by higher sensitiser amounts is present either at the competing site, or diffuse forms described above. Either of these cases gives rise to an increased sensitivity to red light. For many photographic materials which are not intended for red light exposure, this red light sensitivity is a disadvantage in itself as it limits the amount of safelight which can be tolerated, and it is desirable to minimise it. Because of the ratio in which S-sensitizers partition between grains of different size and surface topography in an emulsion, it is necessary to accept a substantial degree of oversensitisation of this sort to ensure that the majority of the emulsion can reach a high degree of sensitivity.

There are a number of disclosures relating to development accelerators and reduction sensitisation where sulphur containing compounds are used. However, chemical sensitisation is referred to as a separate process and where chemical sensitisation is described, the process is generally carried out by the conventional methods, adding sodium thiosulphate to the silver halide emulsion.

The use of polymeric thioethers as development accelerators, as an alternative to alkylene oxide polymers, is described in U.S. Pat. Nos. 3,779,769 and 3,813,247, which both employ thioether copolymers containing the $—CH_2—CH_2—S—CH_2—CH_2—$ moiety. A clear distinction between actual chemical sensitisers and these development accelerators, also referred to as "speed addenda", is taught in these patents. Whereas chemical sensitisers result in the formation of silver sulphide on the surface of the silver halide crystal, development accelerators increase sensitivity without apparently entering into chemical combination with the silver halide. They increase speed by their presence during exposure and processing and require no digestion with the photographic emulsion to produce the increase in speed. Similar use of polymeric thioethers as development accelerators is described in U.S. Pat. No. 3,615,500, using polymers containing a thiomorpholine unit, and respectively using esters ($—O—CH_2—CH_2—S—CH_2—CH_2—OCO(CH_2)_3CO$) in U.S. Pat. No. 5,041,367, and $R—S—(R'O)_n—$ in JP70010989. Alternatively, similar polymeric thioethers are placed in the developing solution in JP3144440. Polymers having thioether-containing pendant groups have been used as synthetic peptisers in JP4151140, and in JP4235546 as deflocculants. In all these cases, the sulphur atoms in the polymers do not form part of functional groups which are known to be labile S-releasers (cf. thiocarbonyl or polysulphide groups) and addition of these polymers in the absence of other, labile sulphur compounds would not be expected to cause S-sensitisation. Consequently a separate chemical digestion stage using conventional sensitisers is provided in these patents for sulphur-sensitisation of the emulsions.

Reduction sensitisation of emulsions in the presence of $R—O_2_SM$, $R—SO_2—SR$, or $R—SO_2—S—L_m—SSO_2R'$ is described in U.S. Pat. No. 5,254,456, U.S. Pat. No. 5,079,138 and U.S. Pat. No. 5,061,614 using ascorbic acid, and in EP348934 using thiourea dioxide, dimethylaminoborane or stannous chloride as the sensitising reductant. In these patents the sulphur containing polymers function only as an auxiliary to the process of reduction sensitisation, the purpose of which is to improve efficiency of photoelectron utilisation by providing $Ag_2°$ centres inside the AgX grains to counter electron-hole recombination. After this reduction sensitisation it is still necessary to carry out surface sulphur-sensitisation to provide sites for latent image formation, and in these patents this is done using the conventional S-sensitiser, sodium thiosulphate, in combination with chloroaurate. The addition of polymer having a pendant $ArS_2O^{2-}$ group to a high sensitivity emulsion before coating has also been described in JP1079742, resulting in improved storage stability. The above cited U.S. Pat. No. 3,779,769 and also SU863595 describe addition to photographic emulsions of polymers containing sulphonate groups $RSO_3Na$ or $RSO_3NH_4$, another form in which sulphur has no sensitising activity.

Sensitisation of simple AgBr emulsions by mixing with high Mw compounds described as having the structure $[AgS(R)]_n$, prepared by adding silver nitrate to the thiols cysteine, 2-aminoethanethiol, or 2-mercaptoethanol are described in BE 767486. These compounds, for which the structures described are inorganic ionic aggregates, consisting of linked sulphide and silver ions, $Ag^+ \cdots (R)S^- \cdots Ag^+ \cdots$, are outside the scope of conventional organic covalently-bonded-backbone polymers.

It has long been known that certain types of gelatin apparently exert a chemical sensitising effect on silver halide emulsions, but it is now well established that this is caused by low molecular weight impurities in the gelatin, and is not caused by functional groups attached to the gelatin polymer itself (see, for example, p.263 of "Photographic Materials and Processes" (Stroebel, Compton, Current and Zakia), pub. Focal Press, 1986; and also "Photographic Gelatin" (S. E. Sheppard), Photographic Journal, August 1925, pp 380–387). Modern photographic gelatins are normally free of such impurities.

BRIEF SUMMARY OF THE INVENTION

According to the present invention there is provided a method of chemical sensitisation comprising adding to a negative-acting silver halide emulsion containing silver halide grains, a sulphur releasing organic polymer having multiple sulphur releasing groups per polymer molecule. There is also provided a negative-acting silver halide photographic emulsion comprising one or more organic polymers having multiple sulphur releasing groups per molecule, said sulphur-releasing groups being selected from thiocarbonyl groups, trisulphide or polysulphide groups.

The present invention provides chemically sensitised silver halide emulsions, which overcome the disadvantages inherent in the conventional methods of sulphur sensitisation, by adding sulphur sensitisers which are polymers having multiple labile-sulphur groups in each molecule. These polymeric S-sensitisers replace the conventional monomeric S-sensitisers such as thiosulphate in the chemical sensitisation process.

DESCRIPTION OF PREFERRED EMBODIMENTS

The polymers may be synthesised to incorporate various types of sulphur-releasing groups such as thione-containing or polysulphide functional groups, either as part of the backbone of the polymer, or as pendant groups. The sulphur-releasing polymers of the present invention will lead to the in situ formation of silver sulphide when in an aqueous solution with silver halide. These polymeric S-sensitizers, added to silver halide emulsions (in particular large-grain iodobromide emulsions) in place of the usual small-molecule sensitisers such as thiosulphate, in combination with the normally used addition of gold complexes, have been found to confer equal or higher sensitivity and low DMIN, whilst giving rise to significantly lower levels of red light sensitivity than are achieved using optimal levels of the conventional small-molecule sulphur sensitisers. The efficiency of chemical sensitisation is increased to allow high sensitivity to be obtained from a minimum of silver sulphide added to the surface of the silver halide grains. These advantages are found both for traditional polyhedral grains, and for emulsions having grains of laminar shape.

The labile-sulphur groups used in this invention can be attached as part of pendant groups from the main chain of the polymers, or can form part of that main chain. The polymers have a conventional covalently-bonded backbone comprising carbon, silicon, nitrogen, boron, phosphorus, oxygen, sulphur, selenium or tellurium atoms. Polymers in which the labile sulphur atom is part of a thiocarbonyl group, or in which it is part of a trisulphide or polysulphide group are preferred sensitisers for use in this invention. Where thiocarbonyl groups are used as the sulphur source, they should exist predominantly in the C=S tautomeric form in which the sulphur is labile toward release, rather than as the ene-thiol tautomer C=C—SH. Thus the thiocarbonyl group should form part of an acyclic chain or part of a non-aromatic ring.

The polymers of the present invention preferably have an average of at least 10 sulphur-releasing functional groups attached to each molecular chain of the polymer and more preferably have at least 30 such groups attached to each chain. The sulphur-releasing group may be selected, for example, from thiocarbonate, dithiocarbonate (xanthate), trithiocarbonate, dithioester, thioamide, thiocarbamate, dithiocarbamate, thiouram, thiourea, dithiooxamide, thioketone and trisulphide.

The sulphur-releasing polymers of the invention may be prepared by conventional techniques. Polymers in which the sulphur-releasing functionality forms part of the backbone are most easily prepared by condensation (step-growth) techniques. For example, reaction of thiophosgene with a diol gives a polymer with thiocarbonate groups in the backbone. Similarly, reaction of a bis(sulfenyl chloride) with sulphide ions gives a polymer incorporating trisulphide groups in the backbone. Alternatively, polyesters, polyamides, polycarbonates or polyurethanes can be synthesised by conventional methods, using one or more starting materials (diols, diacids, diamines, diisocyanates) possessing the requisite sulphur-releasing functionality.

Polymers having sulphur-releasing functionalities pendant to the backbone may be synthesised by polymerisation or copolymerisation of suitable monomers, or by chemical modification of existing polymers. Any of the standard methods of polymerisation may be employed, including the condensation (step-growth) methods outlined above, ring-opening methods, and vinyl addition methods (e.g., involving free radical or ionic chain reactions). An example of a suitable ring-opening polymerisation is the reaction between epichlorohydrin and sodium N,N-dimethyldithiocarbamate, which produces a polyether having pendant N,N-dimethyldithiocarbamate groups. Vinyl monomers (such as styrenes, acrylates, methacrylates, vinyl ethers etc.) substituted with the appropriate sulphur-releasing group may by homopolymerised or copolymerised with conventional monomers to provide polymers useful in the invention. An example of a suitable functional monomer is methyl 4-vinyldithiobenzoate.

In view of the tendency of sulphur compounds to act as inhibitors or chain transfer agents in addition polymerisation reactions, it is frequently preferably to graft sulphur-releasing groups on to an existing polymer chain by appropriate chemical reactions. Suitable polymeric starting materials include polymers derived from allylamine, vinyl acetate, acryloyl chloride, styrene etc. Gelatin itself may be chemically modified (e.g., via its free amino groups) so as to have sulphur-releasing properties, but this is not a preferred embodiment of the invention, as best results have been obtained using wholly synthetic sulphur-releasing polymers.

By the methods outlined above (or analogues thereof), it is possible to prepare a wide range of sulphur-releasing polymers, including (but not restricted to) those having hydrocarbon, polyether, polyester, polyamide, polyurethane, polycarbonate, polythiocarbonate, polysiloxane, polysulphide or polysaccharide backbones.

The sulphur polymers of the present invention differ from polymers previously used in emulsions in that the polymers of the present invention have labile sulphur groups, for example thiocarbonyl or trisulphide groups, which labile groups themselves provide the sulphide which forms the silver sulphide sensitivity speck sites on the emulsion grains. The prior art polymers may adsorb to the surface of the grains and have a modifying effect on their reactivity, but are not themselves known to release sulphide. A functional test to identify polymers qualifying for use in this invention is the ability to sensitise emulsions in the absence of known sulphur-sensitisers.

Polymeric sulphur-releasing sensitisers are generally applicable to all types of negative acting silver halide emulsion, i.e. those having AgBr grains, AgBrI grains containing AgI up to the solution limit, AgBrCl, AgCl, AgBrClI or AgClI. Grains can contain localised inner phases or localised surface regions containing a greater proportion of one or more halides than the grain as a whole and can have surfaces decorated in specific regions by epitaxial growth of any of these halide compositions. Trace dopants consisting of iridium, rhodium, ruthenium or other polyvalent metal cations complexed with halide or other bridging ligands can be incorporated within the grains either uniformally or locally during growth.

The invention is also applicable to grains of any morphology, including octahedral, cubic, tetrahedral, rhombododecahedral, icosatetrahedral and rounded polyhedral shapes, or to tabular grains of either high or low aspect ratio. The habit of the grains can also have been modified by adsorption of dyes or other compounds during growth. Growth of the emulsion can have been in the presence of silver halide solvents, including ammonia, thioethers, and thiocyanate. The emulsions are preferably prepared in an inert ossein gelatine, but can have other peptisers including other gelatines, polyvinylpyrrolidone or other synthetic polymers. However, the emulsions are preferably prepared in a dispersing medium that is essentially free of sensitising ingredients until the addition of the sulphur-releasing polymers of the invention.

The polymeric S-sensitisers of this invention are preferably added to the emulsion after completion of precipitation and physical ripening processes used to grow the grains, and more preferably after removal of excess physical ripeners and by-products of precipitation by washing either using ultrafiltration, coagulation of the emulsion using pH-sensitive modified gelatines or by salting out, followed by resuspension, or using other methods known in the art. They may also be used to chemically sensitise the emulsion prior to growth of a further thin or thick layer of silver halide onto the grains by any known processes, to create shallow or deeply buried internal image emulsions. They may be added to the emulsion as solutions in water or water-soluble solvents such as methanol, ethanol, dimethylformamide (DMF) etc.

The polymeric S-sensitisers of the invention may be used in combination with conventional S-sensitisers such as thiosulphate, but this is not preferred. Preferably less than 50 mol % (more preferably less than 25 mol %) of the sulphur-releasing groups present during chemical sensitisation are derived from a non-polymeric source.

Sulphur sensitisation by the polymers of this invention can be performed in the absence of other chemical sensitisers, or in combination with gold sensitisation using tetrachloroaurate, thiocyanate complexes of gold, or any other known gold sensitisers, added at any time during the sensitisation digest. Palladium or other noble metal ion complexes with halide, thiocyanate or other ligands can be added during or at the end of the sensitisation procedure. Tetraazaindene or other stabilisers can be added at the end of the chemical sensitisation digest, and can also be added prior to the addition of the S-sensitisers, as can any other finish-modifying compounds known in the art.

The emulsions of the invention can optionally be sensitised to light of any visible wavelength, or to the infra-red, using any known spectral sensitising dyes. This spectral sensitisation, which can be accompanied by additions of soluble halide to enhance the adsorption efficiency of the dyes, can be accomplished after completion of the chemical sensitisation, or before or during this process.

The emulsions of the invention can be coated on any transparent or opaque support, either on one side only, or on both sides, and can form part of any multiple layer coating. They may contain any of the usual antifoggants, latent image stabilisers, image tone modifiers, hydrazide nucleators, wetting agents and hardeners. The emulsion can be coated as a photographic element giving a silver image by development, or be coated with colour couplers, including those releasing development inhibitors or other photographically useful groups, so as to give dye images by development. Diffusion transfer printing plates such as those in U.S. Pat. Nos. 4,621,041 and 4,784,933 can also benefit from practice of the invention.

The invention can be better understood by reference to the following examples, which show the synthesis of labile-sulphur polymers S-1 to S-22, and both conventional and tabular AgBrI emulsions containing these polymers as sulphur sensitisers wherein n, m, p, q, and r in the following formulae represent positive whole integers.

S-1
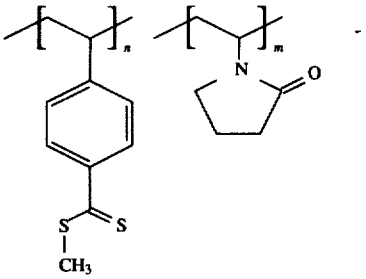
S-2
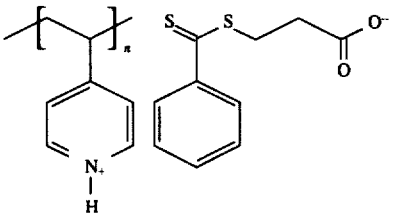
S-3
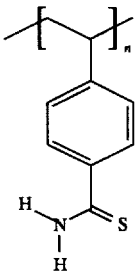
S-4
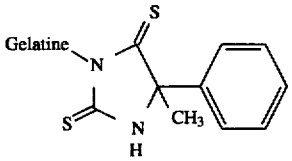
S-5
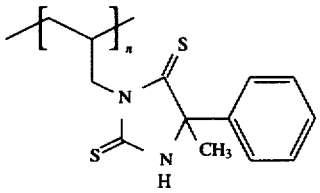
S-6
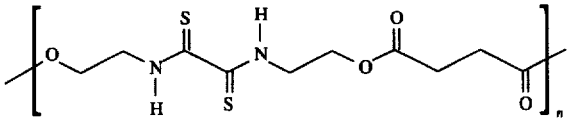
S-7
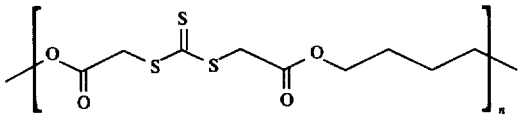
S-8
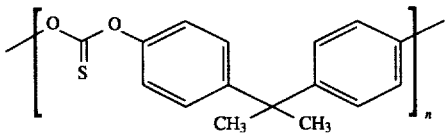

-continued
S-9
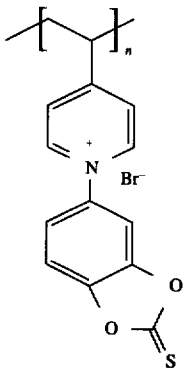
S-10
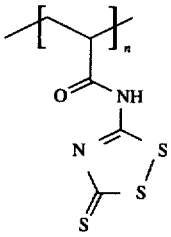
S-11
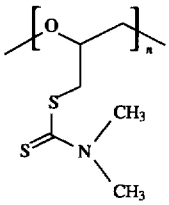
S-12
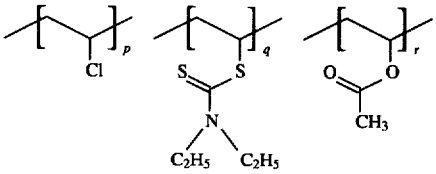
S-13
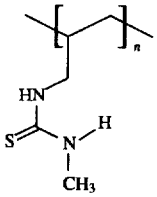
S-14
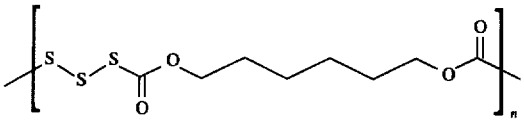
S-15
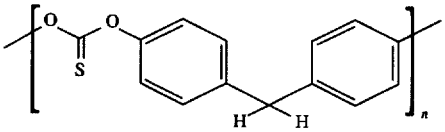
S-16
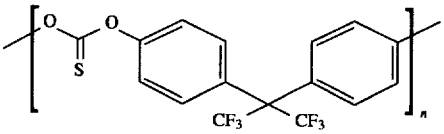

-continued

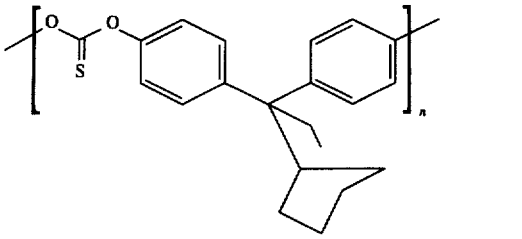

S-17

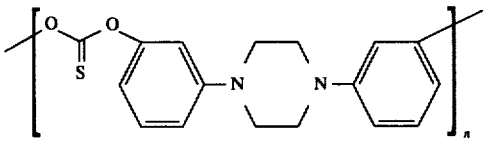

S-18

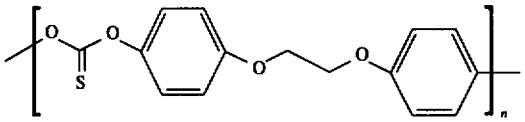

S-19

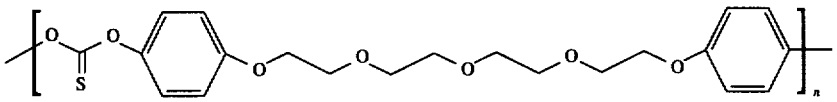

S-20

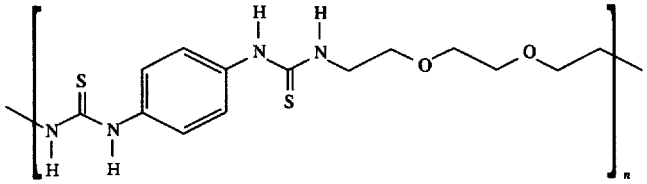

S-21

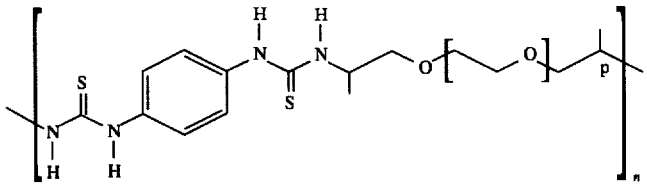

S-22

Repeat p is PEG 500

EXAMPLE 1

Synthesis of polymer S-1

Methyl 4-vinyldithiobenzoate (VMD) was prepared from the starting material 4-chlorostyrene by the procedure described by Haraoubia, Gressier and Levesque in Die Makromol. Chemie, 176, 2143, [1975].

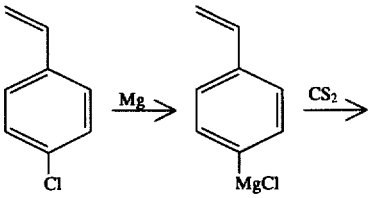

-continued

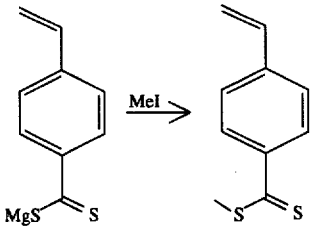

After purification of the monomer by distillation, the overall yield for the three stage reaction was 39%. This monomer was copolymerized with vinylpyrrolidone (1:1 ratio) in toluene, using AIBN initiator (0.01 wt % solids). The copolymer was found by elemental analysis to contain 90% of the VMD monomer, and had a mean molecular weight of 114 000.

EXAMPLE 2

Synthesis of polymer S-2

A substituted vinyl pyridine salt polymer was prepared by dissolving poly(vinyl pyridine) (1.05 g), (Mw 150,000), in 50 ml of methanol and to this solution adding S-thiobenzoylthioglycolic acid (2.12 g). After stirring for two hours, the solvent was evaporated and the residue redissolved in acetone. The polymer was isolated by pouring into a 5-fold excess of ether followed by filtration. Yield 1.23 g. Degree of substitution 25%.

EXAMPLE 3

Synthesis of polymer S-3

In the presence of anhydrous aluminium chloride (5.03 g), ethoxycarbonylisothiocyanate (5 g) was added to a cooled solution of poly(styrene) (4 g) in nitrobenzene. The reaction was allowed to heat up to ambient and left stirring under argon overnight. The product was isolated by filtering the mixture before precipitating into methanol followed by filtration. The polymer was redissolved in nitrobenzene, filtered and precipitated a second time. Yield=3.51 g. Low degree of substitution, sulphur –0.3%.

EXAMPLE 4

Synthesis of polymer S-4

To a solution of gelatine (2 g) in water (80 ml) at 80° C. was added a solution of 4-methyl-4-phenylthiazolidine-2,5-dithione (0.25 g) in ethanol (10 ml). Additional ethanol (50 ml) was added. The functionalised gelatine precipitated, was collected and dried in vacuo.

EXAMPLE 5

Synthesis of polymer S-5

Poly(allylamine) hydrochloride (10 g) was dissolved in 500 ml of methanol. To this solution was added NaOH pellets (4.3 g). After two hours the fine filtrate of sodium chloride was filtered off leaving the free amine polymer in solution. 4-Methyl-4-phenylthiazolidine (2,5-dithione (0.1 equivalents) (2.5 g) was then added. After stirring for two hours and monitoring by t.l.c. the sulphur heterocycle was observed to have been consumed. The resulting methanolic solution was used directly for sensitization of silver halide emulsions, without isolation of solids. Alternatively, the polymer was isolated by pouring into an 5 fold excess of ether, filtering and drying. Yield 10.68 g. Mw=60,000.

EXAMPLE 6

Synthesis of polymer S-6

Into a dry 175 ml polymerisation vessel bishydroxyethyldithio-oxamide (2.1 g), di-isopropyl carbodiimide (1.92 g), tosic acid (0.291 g), dimethylaminopyridine (0.183 g) and 50 ml of DMF were placed. To this solution succinic acid (0.87 g) was added. The vessel was then sealed and left to stir at room temperature for 10 days. A yellow polymer (0.84 g) was isolated by precipitation in methanol and filtration. Mw=177,872.

EXAMPLE 7

Synthesis of polymer S-7

Into a dry 175 ml polymerisation vessel 1,4 butanediol (1.41 g), di-isopropyl carbodiimide (3.84 g), tosic acid (0.582 g), dimethylaminopyridine (0.366 g) and 100 ml of dichloromethane were placed. To this solution biscarboxymethyltrithiocarbonate (3.39 g) was added. The vessel was then sealed and left to stir at room temperature for 10 days. A sticky yellow polymer (1.06 g) was isolated by precipitation in methanol and filtration Mw=3,079.

EXAMPLE 8

Synthesis of polymer S-8

Thiophosgene (0.58 g) in dichloromethane (15 ml) was added dropwise to a stirred mixture of bisphenol A (1.1 g), tetrabutylammonium bromide (0.08 g) and 1M sodium hydroxide (20 ml). After stirring for 2.5 hours, the organic layer was separated and poured into methanol (100 ml). The product was collected by filtration, washed with methanol and dried in vacuo. Mw=19,000. Yield 0.92 g.

EXAMPLE 9

Synthesis of polymer S-9

To a solution of poly(vinylpyridinium bromide-N-catechol) (2.94 g) in 200 ml of dry DMF under a nitrogen atmosphere was added 1.8 g of thiocarbonyl N, N diimidazole. The reaction was left to stir for three days before pouring into a 5 fold excess of acetone. The solid product was collected by filtration and dried at 50° C. under vacuum. Yield 2.3 g. Mw=150,000.

EXAMPLE 10

Synthesis of polymer S-10

3-amino -1,2,4-dithiazole-5-thione (4.14 g) was placed into a vessel containing 100 ml of 1,4 dioxane under nitrogen. To the ice-bath cooled solution was added 25% solids of poly(acryloyl chloride) in 1,4 dioxane (10 g) and after two hours, the yellow solid was collected and washed with acetone. The polymer was found to be soluble in DMF and by GPC, the Mw was determined (Mw=8,000). In order to purify this material the solid was redissolved in DMF, but the solid was not regenerated as a suitable non solvent could not be identified. This polymer was supplied for evaluation in solution.

EXAMPLE 11

Synthesis of polymer S-11

This compound was prepared following the procedure of Bull Chem. Soc. Japan, 41, 707 (1968). To a solution of epichlorohydrin (4.7 g) in DMF (15 ml) was added dropwise a solution of sodium dimethyldithiocarbamate (15 g) in DMF (35 ml). The mixture was stirred for 20 hours, filtered to remove NaCl and poured into water (500 ml). The solid product was collected by filtration and dried in vacuo. The crude product was purified by dissolving in DMF (50 ml) and precipitating in water (500 ml). The resulting suspension was centrifuged, the product collected by filtration, washed with water and dried. Yield 3.4 g, Mw 16,000.

EXAMPLE 12

Synthesis of polymer S-12

A solution of vinyl chloride/vinyl acetate copolymer (2 g) and diethyl dithiocarbamic acid sodium salt (1 g) in DMF (40 ml) was stirred for 7 days. The precipitated sodium chloride was removed by filtration and the solution poured into methanol (150 ml). The product was collected by filtration, washed with methanol and dried in vacuo. Yield 1.44 g.

EXAMPLE 13

Synthesis of polymer S-13

Poly(allylamine) hydrochloride (10 g) Mw=60,000 was refluxed with NaOH (5.4 g) in methanol (200 ml) for 14 hours. After cooling to room temperature, methyl isothiocyanate (7.2 ml) was added and the polymer precipitated. Water (50 ml) was added to form a homogeneous solution which was refluxed for one hour to remove excess isothiocyanate. The solution was poured into water. The polymer was collected, stirred with acetone, and dried in vacuo. Yield 4.6 g I.R. 1500 $cm^{-1}$ C=S.

EXAMPLE 14

Synthesis of polymer S-14

Chlorocarbonylsulfenyl chloride (3.4 g) was added to a solution of 1,6-hexanediol (1.2 g) in n-hexane (2.5 ml). The solution was warmed to 50° C. for 2 hours until HCl evolution stopped. The solvent was removed by evaporation and the product used directly for the preparation of S-14. The above sulfenyl chloride (2.83 g) in chloroform (30 ml) was added dropwise to a solution of sodium sulphide nonahydrate (2.44 g) in water (30 ml) while maintaining a temperature below 10° C. The organic layer and chloroform extract of the aqueous layer were dried ($CaCl_2$, and evaporated to yield the crude polymer.

This was dissolved in dichloromethane (10 ml) and precipitated in methanol (150 ml). The product was collected by filtration, washed with methanol and dried in vacuo. Yield 1.6 g.

EXAMPLE 15

Sensitisation of polyhedral iodobromide emulsion using thiocarbonate polymer S-8

A polyhedral iodobromide emulsion (Emulsion A) containing overall 2.3% AgI and having well rounded grains of mean diameter 0.67 microns was grown in a strongly ammoniacal aqueous inert ossein gelatine medium by methods known in the art. After coagulation and washing to remove soluble inorganic salts, the emulsion was resuspended using further inert gelatine and water to give a silver content of 13.5% and a gelatine content of 4.4%, after which the pH was adjusted to 6.8 and the pAg was adjusted to 9.2 at 40° C. by addition of KBr. The emulsion was heated at 55° C. with continuous stirring and 33 ml of an 0.4% solution of the thiocarbonate polymer S-8 in dimethylformamide (DMF) was added per mole of Ag in the emulsion. After 10 minutes, 19 ml of a solution 0.149 millimolar in gold and 19.6 millimolar in $SCN^-$ prepared by mixing solutions of $NaAuCl_4$ and KSCN, was added per mole Ag. The emulsion was then heated at 55° C. for a further 65 minutes after which 66 ml of an 0.06M solution of 4-methyl-6-hydroxytriazaindolizine was added per mole of silver, and the emulsion rapidly cooled. For coating, the emulsion, melted at 36° C., was treated with a further equal quantity of the triazaindolizine solution, further inert gelatine, 0.12 g/mole Ag of azodicarbonimide in DMF, an aqueous solution of Hostapur SAS surfactant, aqueous 20% polyethylacrylate (PEA) emulsion and Dextran-40, and an aqueous solution of 1,3-divinylsulphonyl-2-hydroxypropane as gelatine hardener. The emulsion was coated on clear, uncoloured PET base at 2.2 g Ag/$m^2$ in a matrix of 2.5 g/$m^2$ gelatine, 0.8 g/$m^2$ dextran and 0.4 g/$m^2$ PEA, containing 0.04 g/$m^2$ vinylsulphone crosslinker, with a protective coat of 1.0 g/$m^2$ gelatine containing the same hardener and surfactant. (Coating P-1).

EXAMPLE 16

Sensitisation of polyhedral iodobromide emulsion using sodium thiosulphate

To the emulsion A, prepared similarly to Example 15 at pH 6.8 and pAg 9.2, and heated at 55° C. was added 20 ml per mole Ag of a freshly prepared millimolar solution of sodium thiosulphate stabilised with sodium carbonate. After 10 minutes, 19 ml of the same 0.149 millimolar gold solution used in Example 15 was added, and the emulsion heated with continuous stirring for a further 160 minutes at 55° C., after which it was stabilised and coated as in Example 15 (Coating C-1). In a further experiment the emulsion was treated in the same way, except that 30 ml per mole Ag of 1 millimolar sodium thiosulphate solution was used, in which case the emulsion was heated for 115 minutes before stabilisation. (Coating C-2).

The film coatings P-1, C-1 and C-2 were exposed for 1 second to white light through a 47B (blue selective) filter, and then processed in 3M XAD3 chemistry, developing for 25 seconds at 34° C. The resulting blue sensitivities (Table 1) show that the polymeric S-releaser S-8 slightly exceeds the sensitisation achieved with 20 micromoles of thiosulphate, and is approximately equal to that achieved with 30 micromoles. To test for unwanted red sensitivity the coatings were exposed to the same source through a No. 29 filter for 100 seconds, and processed in the same way. It can be seen from Table 1 that the polymer-sensitised emulsion has substantially lower red sensitivity than the comparative emulsions, even the one using the lower level of thiosulphate.

TABLE 1

| | | Addn/ | Relative Blue Sensitivity | | | | | Red Sensitivity | | |
|---|---|---|---|---|---|---|---|---|---|---|
| Coating | Sensitizer | mole | D-min | SPD-1 | SPD-2 | CON | Dmax | SPD-1 | SPD-2 | Ct Wt g/$m^2$ |
| P-1 (Inv.) | Polymer S-8 | 33 ml 0.4% | 0.03 | 562 | 269 | 1.32 | 1.67 | 12 | 3 | 2.20 |
| C-1 Comparison | $Na_2S_2O_3$ | 20 ml 1 mM | 0.05 | 500 | 234 | 1.39 | 1.60 | 100 | 40 | 2.26 |
| C-2 Comparison | $Na_2S_2O_3$ | 30 ml 1 mM | 0.05 | 575 | 275 | 1.40 | 1.58 | 126 | 48 | 2.48 |

Speed 1 measured at D = 0.13 above base + fog, speed 2 at 0.5 above base + fog wherein CON is the contrast and CtWt is the coating weight.

EXAMPLE 17

Sensitisation of polyhedral iodobromide emulsion using other polymeric sensitizers To separate portions of emulsion A (prepared similarly to Example 15 and adjusted at 36° C. to the pH and pAg described in Table 2, and then heated at 55° C.), were added other polymeric sensitisers S-5, S-11 or S-2, as detailed in Table 2. As in Example 15, 19 ml of the 0.149 millimolar gold solution was added after 10 minutes, and the emulsion then heated to a sensitivity maximum at 55° C., followed by stabilisation and coating as in Example 15 (Coatings P-2 to P-4). A reference emulsion was treated similarly, but with addition of the gold sensitiser only (Coating C-3). The same sensitometric procedure as in the previous examples was used to evaluate the sensitivity of these coatings to blue light. It can be seen from Table 2 that these sulphur-releasing polymers also confer a high degree of sensitivity to the emulsion. For these polymers, the addition quantities and sensitisation conditions, especially duration, were not optimised to achieve low DMIN. (In all other examples, unless otherwise stated, the described sensitisation conditions are optimised conditions).

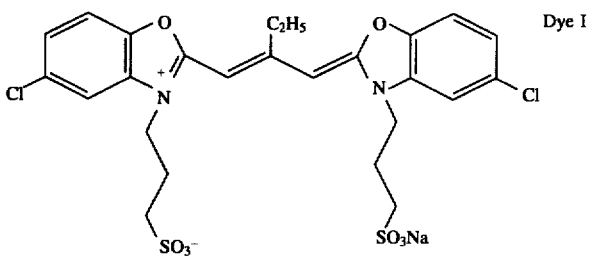

TABLE 2

| | Sensitization Conditions | | | | Sensitivity to Blue Exposure | | | | | |
|---|---|---|---|---|---|---|---|---|---|---|
| | Sensitizer | Addn/mole | pH | pAg | Dmin | SPD-1 | SPD-2 | CON | Dmax | Ct Wt g/m² |
| P-2 Invention | Polymer S-5 | 20 ml 0.4% | 6.5 | 9.0 | 0.10 | 501 | 170 | 0.85 | 1.52 | 2.44 |
| P-3 Invention | Polymer S-11 | 22 ml 0.4% | 6.8 | 9.2 | 0.08 | 630 | 270 | 1.1 | 1.63 | 2.64 |
| P-4 Invention | Polymer S-2 | 11 ml 0.4% | 6.5 | 9.0 | 0.11 | 550 | 240 | 1.11 | 1.45 | 2.28 |
| C-3 Comparison | None | — | 6.8 | 9.2 | 0.07 | 26 | — | 0 | 0.51 | 2.20 |

Speed 1 measured at D = 0.13, speed 2 at 0.5 above base + fog using same sensitivity scale as Table 1

EXAMPLE 18

Sensitisation of a laminar iodobromide emulsion using the polymeric sensitiser S-8

An emulsion B having AgIBr (1% AgI) laminar grains of mean diameter 1.2 microns and mean thickness 0.22 microns was prepared by the general method of U.S. Pat. No. 5,028,521, introducing all the iodide during the final, ammonia assisted, stage of growth. After coagulation and washing to remove soluble inorganic salts, the emulsion was resuspended using further inert gelatine and water to give a silver content of 13.5% and a gelatine content of 6.0%, after which the pH was adjusted to 6.5 and the pAg adjusted to 8.7 at 40° C. by addition of KBr. The emulsion was spectrally sensitised to green light prior to addition of chemical sensitisers by addition of 45 ml of a 1% solution of the dye I per mole Ag, after which it was heated at 50° C. with continuous stirring and 20 ml of an 0.4% solution of the thiocarbonate polymer S-8 in dimethylformamide (DMF) was added per mole Ag. After 10 minutes, 12 ml/mole Ag of a solution 2.89 millimolar in gold and 89 millimolar in $SCN^-$, prepared by mixing solutions of $NaAuCl_4$ and KSCN, was added. The emulsion was then heated at 50° C. for a further 55 minutes after which the emulsion was stabilised and coated similarly to Example 15, except that in the emulsion layer the gelatine was reduced to 1.8 g/m² and the vinylsulphone hardener increased to 0.06 g/m². (Coating P-5).

EXAMPLE 19

Sensitisation of laminar iodobromide emulsion using sodium thiosulphate

To the emulsion B, prepared similarly to Example 18, at pH 6.5 and pAg 8.7, and heated at 55° C. was added 10 ml per mole Ag of a freshly prepared 1 millimolar solution of sodium thiosulphate stabilised with sodium carbonate. After 10 minutes, 12 ml of the same 2.89 millimolar gold solution used in Example 18 was added, and the emulsion heated with continuous stirring for a further 50 minutes at 50° C., after which it was stabilised and coated as in Example 18 (Coating C-4). In further experiments the emulsion was treated in the same way, except that 15 ml per mole Ag of 1 millimolar sodium thiosulphate solution was used, in which case the emulsion was heated for 40 minutes before stabilisation (Coating C-5).

The film coatings P-5, C-4 and C-5 were exposed for 0.1 second to white light through a No. 58 (green selective) filter, and then processed in 3M XAD3 chemistry, developing for 25 seconds at 34° C. The resulting green sensitivities (Table 3) show that the polymeric S-releaser S-8 exceeds the sensitivity achieved with thiosulphate, at a lower DMIN. The red sensitivity of the polymer-sensitised coating P-5 is low, being substantially less than that of the comparison trial C-5 having the higher level of thiosulphate needed to give the best green speeds at higher densities.

TABLE 3

| Coating | Sensitiser | Addn/ mole | Relative Green Sensitivity | | | | | | | Red Sensitivity | |
|---|---|---|---|---|---|---|---|---|---|---|---|
| | | | D-MIN | SPD-1 | SPD-2 | SPD-3 | CON | D-MAX | Ct Wt g/m$^2$ | SPD-1 | SPD-2 |
| P-5 Invention | Polymer S-8 | 20 ml 0.4% | 0.05 | 417 | 204 | 68 | 1.56 | 2.20 | 2.44 | 40 | 16 |
| C-4 Comparison | $Na_2S_2O_3$ | 10 ml 1 mM | 0.06 | 400 | 186 | 59 | 1.55 | 2.14 | 2.35 | 52 | 22 |
| C-5 Comparison | $Na_2S_2O_3$ | 15 ml 1 mM | 0.06 | 400 | 195 | 66 | 1.63 | 2.15 | 2.42 | 100 | 46 |

Speed 1 measured at D = 0.13 above base + fog, speed 2 at 0.5 above base + fog, speed 3 at 1.5 above base + fog

EXAMPLE 20

Sensitisation of a laminar iodobromide emulsion using the polymeric sensitiser S-11, in combination with low level of gold sensitiser

TABLE 4

| Coating | Sensitiser | Addn/ mole | Relative Green Sensitivity | | | | | | | Red Sensitivity | |
|---|---|---|---|---|---|---|---|---|---|---|---|
| | | | D-MIN | SPD-1 | SPD-2 | SPD-3 | CON | D-MAX | Ct Wt g/m$^2$ | SPD-1 | SPD-2 |
| P-6 Invention | Polymer S-11 | 20 ml 0.4% | 0.04 | 575 | 234 | 44 | 1.22 | 1.93 | 2.34 | 24 | 7.5 |
| C-6 Comparison | $Na_2S_2O_3$ | 15 ml 1 mM | 0.07 | 630 | 219 | 17 | 0.94 | 1.90 | 2.46 | 26 | 8 |
| C-7 Comparison | $Na_2S_2O_3$ | 20 ml 1 mM | 0.08 | 575 | 205 | 15 | 0.95 | 1.89 | 2.32 | 42 | 12 |

Speed 1 measred at D = 0.13 above base + fog, speed 2 at 0.5 above base + fog, speed 3 at 1.5 above base + fog The laminar emulsion B, adjusted to pH 6.5 and pAg 8.7 at 40° C. as in Example 18, was spectrally sensitised to green light prior to addition of chemical sensitisers by addition of 45 ml of a 1% solution of Dye I per mole Ag, after which it was heated to 50° C. with continuous stirring and 20 ml of an 0.4% solution of the polymer S-11 in dimethylformamide (DMF) was added per mole Ag. After 10 minutes, 20 ml/mole Ag of a solution 0.149 millimolar in gold and 19.6 in $SCN^-$, prepared by mixing solutions of $NaAuCl_4$ and KSCN, was added. The emulsion was then heated at 50° C. for a further 65 minutes after which the emulsion was stabilised and coated similarly to Examples 18. (Coating P-6).

EXAMPLE 21

Sensitisation of a laminar iodobromide emulsion using sodium thiosulphate and a low level of gold sensitiser The laminar emulsion B, prepared and spectrally sensitised as in Example 20 was heated at 50° C. with continuous stirring whilst 15 or 20 ml of stabilised 1 mM sodium thiosulphate was added per mole Ag in separate experiments. After 10 minutes, 20 ml/mole Ag of the 0.149 millimolar gold solution was added as in Example 21 in each case. The emulsions were then heated at 50° C. for a further 30 minutes after which the emulsion was stabilised and coated similarly to Example 18. (Coatings C-6 and C-7).

The film coatings P-6, C-6 and C-7 were exposed for 0.1 second to white light through a No. 58 (green selective) filter, and then processed in 3M XAD3 chemistry, developing for 25 seconds at 34° C. The resulting green sensitivities (Table 4) show that the polymeric S-releaser S-11 enables high speed and reasonable contrast to be obtained at a very good low DMIN despite the low level of gold. With the conventional sensitisers it is necessary to use a high gold addition for laminar grains as in Example 19, to avoid low contrast and increased fog, as can be seen for coatings C-6 in Table 4. This is again achieved at a low level of red sensitivity for the polymer-sensitised coating P-6.

EXAMPLE 22

Sensitisation of polyhedral iodobromide emulsion using polymeric sensitizers having a thiocarbonate sensitising group, using different chain forming components.

Example 15 shows the advantages in sensitisation gained from the use of the thiocarbonate polymer S-8, which was synthesised by forming active thiocarbonate groups through reaction of thiophosgene with bisphenol-A as the diol component. Polymers S-15 to S-20 were synthesised analogously using different diols, giving polymers having the same thiocarbonate sensitising group, but in which the linking groups forming their backbones differ markedly from that of S-8 either in rigidity, length, or affinity for polar solvents such as water. In the polymer S-9 the thiocarbonate group forms part of a ring.

To separate portions of emulsion A, prepared similarly to Example 15 and adjusted at 36° C. to pH 6.8 and pAg 9.0, and then heated to 50° C. were added to the polymeric thiocarbonates, as reported in Table 5. As in Example 15, 19 ml of the 0.149 millimolar gold solution was added after 10 minutes, and the emulsion then heated to an approximate sensitivity maximum at 50° C., followed by stabilisation and coating as in Example 15 (Coatings P-7 to P-12). The same sensitometric procedure as in the previous examples was used to evaluate the sensitivity of these coatings to blue light. For these polymeric sensitisers, the level shown in Table 5 was the best chosen from a range of addition quantities, and the quantity of labile sulphur (micromoles C=S) required is strongly related to the properties of the polymer imparted by the chain forming diol unit, especially rigidity. In all cases, however, the appropriate quantity of S-releasing polymer can be seen to effectively sensitise the emulsion. As in Example 17, the other sensitisation conditions were not optimised to obtain the best ratio of sensitivity and contrast to DMIN.

TABLE 5

| | Sensitiser Additions | | | Sensitivity to Blue Exposure | | | | | |
|---|---|---|---|---|---|---|---|---|---|
| | Sensitiser | Addn/ mole | Micro moles C=S | D-MIN | SPD-1 | SPD-2 | CON | D-MAX | Ct Wt g/m² |
| P-7 Invention | Polymer S-15 | 5 ml 0.4% | 80 | 0.06 | 445 | 170 | 1.08 | 2.03 | 2.92 |
| P-8 Invention | Polymer S-16 | 23 ml 0.4% | 250 | 0.08 | 455 | 165 | 1.03 | 1.88 | 2.38 |
| P-9 Invention | Polymer S-17 | 30 ml 0.4% | 370 | 0.14 | 525 | 140 | 0.55 | 1.28 | 1.92 |
| P-10 Invention | Polymer | 5 ml | 60 | 0.15 | 400 | 80 | 0.45 | 1.26 | 2.26 |
| P-11 Invention | Polymer S-19 | 11 ml 0.4% | 190 | 0.17 | 630 | 200 | 0.82 | 1.49 | 2.50 |
| P-12 Invention | Polymer S-9 | 40 ml 0.2%§ | 30 | 0.14 | 365 | 155 | 1.10 | 1.70 | 2.63 |

Speed 1 measured at D = 0.13, speed 2 at 0.5 above base + fog, using same sensitivity scale as Table 1.
§Analysed sulphur-content of S-9 is 1.15%, i.e. 12% of pendant groups have C=S functionality.

EXAMPLE 23

Sensitisation of a laminar iodobromide emulsion using polymeric sensitizers having a thiocarbonate sensitising groups, using different chain forming components.

A further laminar AgBr emulsion C also of 1% AgI, having grains of mean diameter 1.2 microns and a mean thickness of 0.19 microns, was prepared similarly to emulsion B in Example 18, except that the gelatine content was limited to 10 g per mole of silver. To separate portions of C were added in place of S-8, the other polymeric thiocarbonate sensitisers S-15 to S-20, as reported in Table 6. The emulsions were heated to an approximate sensitivity maximum at 50° C., making the same additions of spectral sensitising dye, gold complex, and stabiliser as in Example 18, increasing the gelatine to 70 g per mole of silver, the same as in Example 18, by addition of 16% gelatine at 50° C., five minutes after addition of the gold complex. The emulsions were coated similarly to Example 18, but on blue PET base. The same sensitometric procedure for exposure to green light described in Example 19 was used to evaluate the sensitivity of these coatings. As in Example 22, the sensitisations were optimised only for quantity of sensitising polymer, of which similar relative quantities were again required, confirming the influence of the chain-forming molecular component on reactivity of the thiocarbonate group.

EXAMPLE 24

Sensitisation of polyhedral iodobromide emulsion using a polymeric dithioester sensitizer, showing the influence of the molecular weight of the polymer.

To separate portions of emulsion A, prepared similarly to Example 15 and adjusted at 36° C. to pH 6.8 and pAg 9.0, and then heated to 50° C. were added the polymeric dithioester sensitiser S-1 having a molecular weight of 115,000, and another sample of the same compound having a molecular weight of 10,000 made using modified polymerisation conditions, as shown in Table 7. As in Example 15, 19 ml of the 0.149 millimolar gold solution was added after 10 minutes, and the emulsion then heated to an approximate sensitivity maximum at 50° C., followed by stabilisation and coating as in Example 15 (Coatings P-19 and P-20). The same sensitometric procedure as in the previous examples was used to evaluate the sensitivity of these coatings to blue light. In both cases, the emulsion was brought to high sensitivity, but the higher molecular weight polymer, of which the optimal quantity was approximately twice that of the lower MW one, enabled this to be achieved at a lower DMIN.

TABLE 6

| | Sensitiser Additions | | | Sensitivity to Green Exposure | | | | | |
|---|---|---|---|---|---|---|---|---|---|
| | Sensitiser | Addn/ mole | Micro-moles C=S | D-MIN‡ | SPD-1 | SPD-2 | CON | D-MAX | Ct Wt g/m² |
| P-13 Invention | Polymer S-15 | 5 ml 0.2% | 40 | 0.17 | 230 | 117 | 1.51 | 1.94 | 2.16 |
| P-14 Invention | Polymer S-16 | 47 ml 0.4% | 490 | 0.21 | 310 | 148 | 1.43 | 1.99 | 2.17 |
| P-15 Invention | Polymer S-17 | 40 ml 0.4% | 495 | 0.19 | 265 | 130 | 1.50 | 2.04 | 2.34 |
| P-16 Invention | Polymer S-18 | 8 ml 0.2% | 50 | 0.18 | 355 | 155 | 1.20 | 1.84 | 1.97 |
| P-17 Invention | Polymer S-19 | 14 ml 0.4% | 240 | 0.20 | 315 | 155 | 1.52 | 1.92 | 2.31 |
| P-18 Invention | Polymer S-20 | 10 ml 0.4% | 95 | 0.16 | 240 | 120 | 1.48 | 2.13 | 2.22 |

Speed 1 measured at D = 0.13, speed 2 at 0.5 above base + fog.
‡Blue base contributes approximately 0.16 to DMIN.

TABLE 7

| | Sensitiser Additions | | | Sensitivity to Blue Exposure | | | | | |
|---|---|---|---|---|---|---|---|---|---|
| | Sensitiser | Addn/ mole | Micro-moles C=S | D-MIN | SPD-1 | SPD-2 | CON | D-MAX | Ct Wt g/m² |
| P-19 Invention | Polymer S-1 MW = 115000 | 80 ml 0.1% | 340 | 0.06 | 525 | 205 | 1.08 | 2.03 | 2.92 |
| P-20 Invention | Polymer S-1 MW = 10000 | 40 ml 0.1% | 170 | 0.10 | 490 | 210 | 1.03 | 1.88 | 2.38 |

Speed 1 measured at D = 0.13, speed 2 at 0.5 above base + fog, using same sensitivity scale as Table 1.

EXAMPLE 25

Sensitisation of polyhedral iodobromide emulsion using a polymeric thiourea sensitizer, showing limitations of aqueous solubility overcome by appropriate chain-forming component.

To separate portions of emulsion A, prepared similarly to Example 15 and adjusted at 36° C. to pH 6.8 and pAg 9.0, and then heated to 50° C. were added the polymeric thioureas, S-21, S-22, and S-13 as shown in Table 8. As in Example 15, 19 ml of the 0.149 millimolar gold solution was added after 10 minutes, and the emulsion then heated to an approximate sensitivity maximum at 50° C., followed by stabilisation and coating as in Example 15 (Coatings P-21 to P-23). The same sensitometric procedure as in the previous examples was used to evaluate the sensitivity of these coatings to blue light. The polymer S-13 brings about negligible sensitisation of the emulsion despite monomeric thioureas being known to be useful sensitisers. This is attributable to the poor solubility of thiourea homopolymers, which evidently prevents appreciable interaction of polymer S-13 with the AgX grains in the aqueous emulsion. The polymers S-21 and S-22 enable a substantial degree of sensitisation to be achieved from the thiourea sulphur-releasing group, by overcome this solubility limitation with chains linking the thiourea groups comprising water-compatible glycol components.

To emulsion A, prepared similarly to Example 15 and adjusted at 36° C. to pH 6.8 and pAg 9.0, and then heated to 55° C. was added the polymeric trisulphide S-14, as shown in Table 9. As in Example 15, 19 ml of the 0.149 millimolar gold solution was added after 10 minutes, and the emulsion then heated to an approximate sensitivity maximum at 55° C., followed by stabilisation and coating as in Example 15 (Coating P-24). The same sensitometric procedure as in the previous examples was used to evaluate the sensitivity of these coatings to blue light. The trisulphide groups in the polymer S-14 can effectively release sulphur to sensitise the emulsion.

TABLE 8

| | Sensitiser Additions | | | Sensitivity to Blue Exposure | | | | | |
|---|---|---|---|---|---|---|---|---|---|
| | Sensitiser | Addn/ mole | Micro-moles C=S | D-MIN | SPD-1 | SPD-2 | CON | D-MAX | Ct Wt g/m² |
| P-21 Invention | Polymer S-21 | 25 ml 0.4% | 290 | 0.08 | 265 | 42 | 0.54 | 1.35 | 2.29 |
| P-22 Invention | Polymer S-22 | 24 ml 0.4% | 115 | 0.16 | 115 | 45 | 0.91 | 1.68 | 2.68 |
| P-23 | Polymer S-13 | 60 ml 0.1% | 480 | 0.03 | 16 | — | 0 | 0.38 | 2.73 |

Speed 1 measured at D = 0.13, speed 2 at 0.5 above base + fog, using same sensitivity scale as Table 1.

EXAMPLE 26

Sensitisation of polyhedral iodobromide emulsion using a polymeric sensitizer having a trisulphide sulphur-releasing group.

TABLE 9

| | Sensitiser Additions | | | Sensitivity to Blue Exposure | | | | | |
|---|---|---|---|---|---|---|---|---|---|
| | Sensitiser | Addn/ mole | Micro-moles C=S | D-MIN | SPD-1 | SPD-2 | CON | D-MAX | Ct Wt g/m$^2$ |
| P-24 Invention | Polymer S-14 | 20 ml 0.4% | 300 | 0.22 | 140 | 55 | 1.06 | 1.55 | 2.35 |

Speed 1 measured at D = 0.13, speed 2 at 0.5 above base + fog, using same sensitivity scale as Table 1.

EXAMPLE 27

Sensitisation of a large grain high iodide colour negative emulsion using polymeric sensitisers.

An iodobromide emulsion of overall 12% iodide content, having thick flattened octahedral grains of mean diameter 1.1 microns and broad size distribution was grown in ammoniacal aqueous inert ossein gelatine medium by methods known in the art. After washing by ultrafiltration to remove soluble inorganic salts, the emulsion, having a silver content of 13.5% and a gelatine content of 3% was adjusted to pH 6.8 and pAg 8.75 at 36° C. The emulsion was then heated to 55° C. with continuous stirring and 20 ml of an 0.4% solution of the thiocarbonate polymer S-8 in DMF added per mole of silver in the emulsion. After 10 minutes 17 ml of a solution 0.165 millimolar in gold ($NaAuCl_4$) and 17.5 millimolar in KSCN was added per mole of silver. The emulsion was heated at 55° C. to a sensitivity maximum after which it was stabilised with 60 ml of an 0.06M solution of 4-methyl-6-hydroxy-triazindolizine, and further inert ossein gelatine (30 g/mole) added. After addition of a suspension of yellow-image-forming coupler, (125 g/mole of silver) the emulsion was coated with surfactant and dichlorotriazine hardener onto clear triacetate film-base to give a test coating having 1.5 g Ag/m$^2$, together with a gelatine topcoat of 1 g gelatine per m$^2$.(Coating P-25) A comparison coating was similarly made of the same emulsion optimally sensitised with a conventional monomeric thiosulphonate as the sulphur source, together with the same gold sensitiser and other additions. (Coating C-8). The coatings were exposed to 1/125 through a No. 12 filter, and processed in standard C-41 chemistry. Table 10 shows that the polymeric sensitiser S-8 is also able to sensitise large grain octahedral emulsions to very high sensitivity under chromogenic development.

TABLE 10

| | Sensitiser | Sensitivity to Blue Exposure | | | | | |
|---|---|---|---|---|---|---|---|
| | Additions Sensitiser | D-MIN | SPD-1 | SPD-2 | CON | D-MAX | Ct Wt g/m$^2$ |
| P-25 Invention | Polymer S-8 | 0.15 | 550 | 62 | 0.71 | 1.61 | 1.6 |
| C-8 | Conventional | 0.23 | 440 | 48 | 0.78 | 2.15 | 2.0 |

Speed 1 measured at D = 0.2, speed 2 at 1.0 above base + fog, using M-blue densitometer filter.

We claim:

1. A method of chemical sensitisation which comprises providing a silver halide emulsion containing negative-acting silver halide grains, and adding to said silver halide emulsion a sulphur releasing organic polymer having multiple sulphur releasing groups per polymer molecule.

2. A method according to claim 1 wherein said sulphur releasing groups are members selected from the group consisting of thiocarbonyl groups, trisulphide and polysulphide groups.

3. A method according to claim 2 wherein said sulphur releasing group is a member selected from the group consisting of thiocarbonate, dithiocarbonate, trithiocarbonate, dithioester, thioamide, thiocarbamate, dithiocarbamate, thiouram, thiourea, dithiooxamide, thioketone and trisulphide.

4. A method according to claim 1 wherein said polymer has a main chain and said sulphur releasing groups are present in pendant groups to the main chain of the polymer.

5. A method according to claim 1 wherein said polymer has a main chain and said sulphur releasing groups are present in the main chain of the polymer.

6. A method according to claim 4 wherein said polymer comprises a covalently bonded backbone chain comprising atoms which are members selected from the group consisting of carbon, silicon, nitrogen, boron, phosphorus, oxygen, sulphur and tellurium.

7. A method according to claim 3 wherein said polymer has at least 10 sulphur releasing groups per polymer molecule.

8. A method according to claim 7 wherein said polymer has at least 30 sulphur releasing groups per molecule.

9. A method according to claim 1 wherein said sulphur releasing polymer is added to the emulsion after completion of precipitation and physical ripening to grow the grains.

10. A method according to claim 9 wherein said sulphur releasing polymer is added after washing of the emulsion to remove excess physical ripeners and by-products of precipitation.

11. A method according to claim 1 wherein said sulphur releasing polymer is added to the emulsion prior to growth of a further thin or thick layer of silver halide onto said grains.

12. A method according to claim 1 wherein said chemical sensitisation further comprises the addition of gold sensitisers.

13. A silver halide photographic emulsion comprising silver halide grains and at least one organic polymer having multiple sulphur releasing groups per molecule, said sulphur-releasing groups being members selected from the group consisting of thiocarbonyl groups, trisulphide and polysulphide groups.

14. A silver halide photographic emulsion according to claim 13 wherein said sulphur releasing groups are members selected from the group consisting of thiocarbonate, dithiocarbonate, trithiocarbonate, dithioester, thioamide, thiocarbamate, dithiocarbamate, thiouram, thiourea, dithiooxamide, thioketone and trisulphide.

15. A method of chemical sensitisation which comprises providing a silver halide emulsion containing negative-acting silver halide grains, and adding to said silver halide emulsion a sulphur releasing organic polymer having multiple sulphur releasing groups per polymer molecule wherein said sulphur releasing groups are members selected from the group consisting of thiocarbonyl groups, trisulphide, polysulphide groups, thiocarbonate groups, dithiocarbonate groups, trithiocarbonate groups, dithioester groups, thioamide groups, thiocarbamate groups, dithiocarbamate groups, thiouram groups, thiourea groups, dithiooxamide groups, thioketone groups and trisulphide groups.

16. A method according to claim 15 wherein said sulphur releasing polymer is added after washing of the emulsion to remove excess physical ripeners and by-products of precipitation.

17. A method according to claim 15 wherein said polymer has at least 10 sulphur releasing groups per polymer molecule.

18. A method according to claim 17 wherein said polymer has at least 30 sulphur releasing groups per molecule.

19. A method according to claim 16 wherein said polymer has at least 10 sulphur releasing groups per polymer molecule.

20. A method according to claim 16 wherein said polymer has at least 30 sulphur releasing groups per molecule.

* * * * *